US005168742A

United States Patent [19]

Heyes et al.

[11] Patent Number: 5,168,742

[45] Date of Patent: Dec. 8, 1992

[54] METHOD AND APPARATUS FOR FORMING WALL IRONED ARTICLES

[75] Inventors: Peter J. Heyes; Stephen J. Digby; Steven P. Williams; Kevin M. Ambrose; Pravin Mistry, all of Wantage, United Kingdom

[73] Assignee: CMB Foodcan plc, Woodside, United Kingdom

[21] Appl. No.: 634,194

[22] PCT Filed: May 23, 1990

[86] PCT No.: PCT/GB90/00804

§ 371 Date: Jan. 17, 1991

§ 102(e) Date: Jan. 17, 1991

[87] PCT Pub. No.: WO90/14901

PCT Pub. Date: Dec. 13, 1990

[30] Foreign Application Priority Data

Jun. 8, 1989 [GB] United Kingdom ..... 8913209

[51] Int. Cl.[5] ..... B21C 25/02; B21D 22/20

[52] U.S. Cl. ..... 72/379.4; 428/34.4; 428/698; 72/347; 72/349; 72/467

[58] Field of Search ..... 220/608; 72/347, 349, 72/467, 379.4; 428/34.4, 698

[56] References Cited

U.S. PATENT DOCUMENTS

| | | | |
|---|---|---|---|
| 3,765,206 | 10/1973 | Shah | 72/347 |
| 3,930,396 | 1/1976 | Martinez | 72/347 |
| 4,040,282 | 9/1977 | Saunders | 72/349 |
| 4,228,673 | 10/1980 | Scheel | 72/467 |
| 4,254,652 | 3/1981 | Proctor | 72/467 |
| 4,425,778 | 1/1984 | Franek | 72/347 |
| 4,442,692 | 4/1984 | Lyu | 72/349 |
| 4,843,863 | 6/1989 | Grims | 72/349 |
| 4,881,394 | 11/1989 | Jansen | 72/347 |

FOREIGN PATENT DOCUMENTS

| | | |
|---|---|---|
| 1488968 | 10/1977 | United Kingdom . |
| 1524675 | 9/1978 | United Kingdom . |
| 1589131 | 5/1981 | United Kingdom . |
| 2092931 | 8/1982 | United Kingdom . |
| 2092932 | 8/1982 | United Kingdom . |

*Primary Examiner*—Ellis P. Robinson
*Assistant Examiner*—Rena L. Dye
*Attorney, Agent, or Firm*—Burns, Doane, Swecker & Mathis

[57] ABSTRACT

A wall ironing ring (8, 11, 14) for use in cooperation with a punch (1) to reduce the thickness of a sidewall of a cup (17) drawn from a laminate of a polyester film and sheet aluminum or sheet aluminum alloy has a frusto conical entry surface (24) to the ring which converges at an angle between 1° and 4° to a central axis perpendicular to the plane of the ring and terminates at a land of short length, measured at said axis; and divergent exit surface extends from said land at an angle in the range from 5° to 15°. The ironing ring may be made from a material having a thermal conductivity greater than 50 W/m°C. used in cooperation with a like ring of smaller land diameter held apart from the first ring by a spacer (7) in which coolant is applied to the cup.

11 Claims, 2 Drawing Sheets

| IRONING DIE | RADIAL CLEARANCE |
|---|---|
| 1st IRON | 0.241mm |
| 2nd IRON | 0.178mm |
| 3rd IRON | 0.105mm |

METHOD AND APPARATUS FOR FORMING WALL IRONED ARTICLES

This invention relates to the manufacture of cans and like articles from laminates of polymeric film and metal sheet by blanking a disc from the laminate, drawing a cup from the disc, and mounting the cup on a punch which is passed through at least one ironing ring to thin and elongate the side wall of the cup; and more particularly but not exclusively to ironing rings suitable for ironing the side wall of cups made from laminates of polymeric film, such as polyesters, and sheet metal.

British Patent Application published No. 2003415A describes laminates of polymeric film adhered to a metal sheet and discusses characteristics necessary for the laminate to survive a drawing and wall ironing process. One of these characteristics is said to be that "it will be capable of reflow at temperatures from about 400° F. to about 450° F. (circa 204° to 232° C.) depending upon the particular resin and consistent with its degradation properties". Preferred laminates described include polyvinyl chloride or polypropylene film, adhered to aluminium or steel, by an adhesive such as maleic anhydride modified polypropylene. The film may be applied to both major surfaces of the metal: alternatively a laminate of film on one major surface and a partially cured epoxy-phenolic resin coating on the other major surface was drawing and ironed with the partially cured coating on the interior of the drawn and ironed workpiece. It is mentioned that "Reflow of the film laminate and coatings may occur during forming or subsequently during washing, decorating or interior coating may effectively heal and eliminate metal exposure" on both the inside and outside of the can. Such reflow indicates a severe reduction of sidewall thickness confirmed by example in which the cup sidewall thickness 0.26 mm was reduced to about 0.10 mm using a drawing and ironing assembly described in British Patent No. 1,517,732. Our work with laminates of polyester film and sheet metal, such as aluminium alloy, indicates that the heat necessary to cause reflow of a polyester film will cause undesirable change to the structure of the film.

British Patent Application published Nos. 2092931A and 2092932A describe press tools in which a precoated metal blank is drawn to a cup which is then concurrently drawn and ironed to make a container body having a side wall approximately 0.001" (0.25 mm) thinner than the blank. This corrective ironing is imposed by mounting the cup on a blank holder which surrounds a punch. The bottom of the cup is pressed against an end face of a combination die as entering of the punch into the die reduces the overall diameter of the cup against the die radius. Continued punch travel pushes the newly formed sidewall into a frusto-conical die portion which converges at an angle in a range of ½° to 3° to compress the sidewall before the sidewall enters a land of axial length between 0.25 and 2.25 mm. A relief portion supports the land and diverges from it at an angle. The work done in such combination dies is more than is done in separate drawing or ironing dies so that there is a risk of excessive heating of a laminate drawn and ironed in such dies. Furthermore, each press tool to achieve a reduction in overall diameter of a cup requires a dedicated punch, blank-holder and die. In contrast, a series of ironing rings or dies, each of smaller land diameter than the previous ring, can cooperate with a single punch and give opportunity for application coolant to the workpiece between the rings.

Using apparatus in which a single punch cooperates with such a progression of ironings, we have wall ironed cups formed from laminates of polyester and aluminium alloy. We have observed that it is necessary to prevent excessive heat at the ironing rings in order to avoid damage of the polyester film as the side wall of our cups was reduced in thickness by 10% or more. The degree of coating damage depends on the melting point of the polyester film; increasing as the melting point is reduced.

In a first aspect this invention provides a wall ironing ring for use in cooperation with a punch entered therethrough to reduce the thickness of a sidewall of a cup drawn from a laminate of a polyester film and sheet aluminium or sheet aluminium alloy; wherein a frusto conical entry surface to the ring converges at an angle between 1° and 4° to a central axis perpendicular to the plane of the ring and terminates at a land of short length, measured at said axis; wherein a divergent exit surface extends from said land at an angle in the range from 5° to 15°; and wherein the ring is made of a wear resistant material having a thermal conductivity greater than 50 W/m°C.

In a second aspect the ring comprises a first planar surface, a second planar surface, a peripheral wall joining said planar surfaces, and a bore defined by a convergent frusto conical entry surface inclined to the axis of the bore at an angle in the range of 1° to 4°; a divergent frusto conical exit surface inclined to the axis of the bore at an angle in the range of 5° to 15°; and a cylindrical land of length, as measured on the axis, in the range of 0.25 mm to 1.25 mm, which connects the entry surface to the exit surface.

In a preferred embodiment the entry surface is inclined to the axis at an angle of 2° and the land length is 0.635 mm.

It is desirable that our ironing rings be made of a wear resistant material having a thermal conductivity greater than 50 W/m°C. Suitable materials include tungsten/nickel/zirconia, tungsten/nickel/diboride, and tungsten carbide in a metal matrix such as cobalt.

Our rings may be incorporated in a press tool assembly comprising a first ironing ring, a second ironing ring, and a hollow spacer to hold the rings apart. The spacer may have a radial passageway through which a coolant fluid can be passed to cool a workpiece on a punch as it passes through the hollow from the first ring to the second ring.

In a third aspect this invention provides a method of making a hollow vessel having an end wall spanning a tubular sidewall thinner than said end wall said method including the steps of; providing a cup formed from a laminate of a polyester film and aluminium or aluminium alloy sheet; mounting the cup on a punch and applying a coolant fluid to the exterior of the cup; passing the cup and punch through a wall ironing ring having a frusto conical entry surface which converges at an angle in the range 1° to 4° to the axis of the punch to terminate in a substantially cylindrical land of length measured at the punch axis in a range of 0.25 mm to 1.25 mm to define with the punch a radial clearance less than the thickness of the side wall of the cup so that the sidewall becomes thinned and elongated. In one embodiment of the method, after passage through the first ironing ring the punch is passed through a hollow spacer to clear the elongated cup from the ironing ring and receive further coolant before passage through a second ironing ring of the convergent angle and land length, but defining a smaller clearance between the punch and land than that between the first land and punch, so to further thin and elongate the sidewall of the cup.

In a preferred method the convergent angle of the or each ring is 2° to the axis of the punch.

Various embodiments will now be described by way of example and with reference to the accompanying drawings in which.

Many millions of drawn and wall ironed cans have been made from tinplate or aluminium alloy. In both cases the cup and whole tool pack of ironing rings are lubricated by a flood of coolant, usually a dilute formulation of a coolant in water. The tin on tinplate is believed to act as a barrier lubricant to prevent seizure of the cup as it is pushed by the punch through the ironing rings. However, the presence of apolymeric coating or film on the cup presents a different rheological problem.

Figure 1:
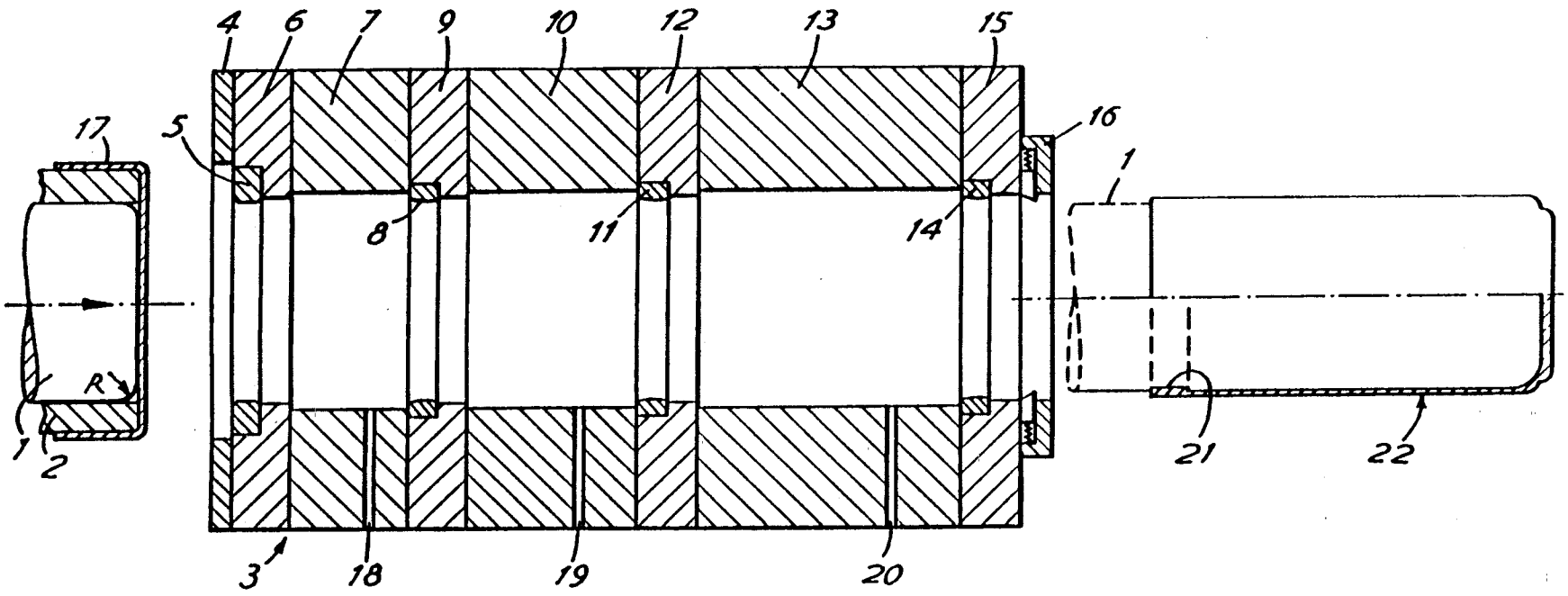
FIG. 1 is a diagrammatic sectioned side view of apparatus for redrawing and wall ironing a cup to form a can body.

Whilst some can makers use an assembly of ironing rings spaced apart along the line of punch travel at a close spacing so the cup is temporarily in two rings at once we prefer the arrangement shown in FIG. 1 because the cup clears each ironing ring before entering the next ring so the cup has time to cool between rings.

In FIG. 1 the apparatus comprises a punch 1 surrounded by a blank holding sleeve 2, the blank holder and punch being reciprocable along their longitudinal axis to cooperate with a die assembly 3 comprising a centering ring 4, and redraw die 5, a redraw die holder 6, a first spacer 7, a first ironing ring 8 supported in a first ring support 9, a second spacer 10, a second ironing ring 11, supported in a second ring support 12, a third spacer 13, a third ironing ring 14 supported in a third ring support 15 and a stripper 16.

When a cup 17, mounted on the punch 1 blank holder 2, is moved towards the redraw die 5, the blank holder 2 cooperates with the face of the redraw die 5 to restrain peripheral material of the cup as the punch 1 pushes the cup into the redraw die 5.

The first spacer 7 is of a length to ensure that the redrawn cup (not shown) clears the redraw die 5 before entering the first ironing ring 8. The first spacer has a radial passage way 18 through which a lubricant is passed to lubricate and cool the exterior of the redrawn cup.

After passage through the first ironing ring 8, the wall ironed cup enters the second spacer 10 where lubricant/coolant is applied from a radial passage way 19 before the ironed cup enters the second ironing ring 11. The second spacer 10 is of a length to ensure that the wall ironed cup is clear of the first ironing ring 8 before it enters the second ironing ring 11.

After passage through the second ironing ring 11 further lubricant/coolant is applied from a radial passage way 20 in the third spacer 13 before entering the third ironing ring 14. After passage through the third ironing ring the punch may, if desired, act on a doming pad (not shown) to form a bottom profile to the wall ironed can body. As the punch proceeds to return to the start position (as shown in FIG. 1) the free edge of the can body strikes stripper fingers 16 which remove the wall ironed can body from the punch. In order to prevent damage at the stripper it is customary to use a punch having an annulus 21 of reduced diameter so that the marginal edge of the rim of the wall ironed can 22 is thicker than the rest of the ironed side wall, as can be seen in FIG. 1.

Figure 2:
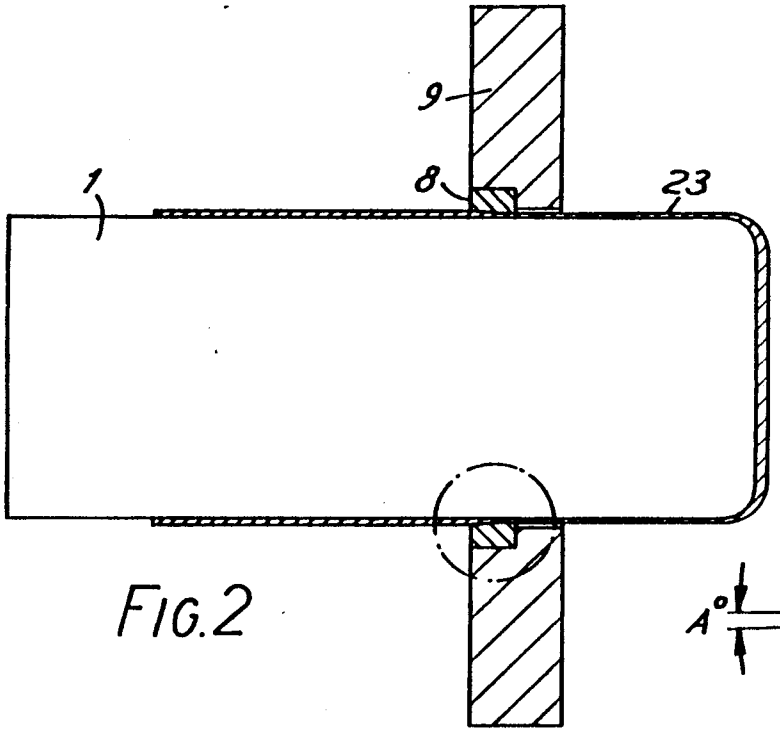
FIG. 2 is a sectioned side view of a punch and ironing ring with a cup passing through it.

One object of this invention is to use the apparatus of FIG. 1 to wall iron a cup made from a laminate of aluminium alloy and a polymeric film. FIG. 2 shows that the ironing ring 8 imposes on radially inwardly directed thrust onto the side wall of the cup as the punch travel imposes a tensile load on the wall material 23 emerging from the ring. Friction at the interface of the ironing ring and can wall generates heat which must be controlled to prevent damage to the polymeric film.

Figure 3:
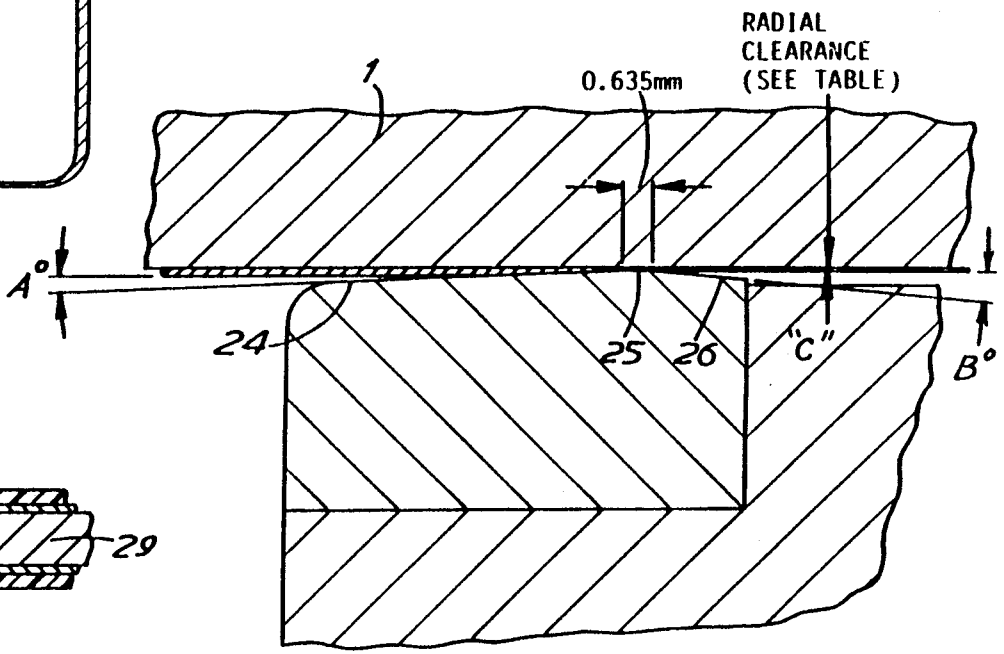
FIG. 3 is an enlarged fragmentary view of the ring and can sidewall of FIG. 2.

In FIG. 3 our wall ironing ring has a converging frusto conical entry surface 24 inclined at an angle A° in the range of 1° to 4° to the axis of the ring, a substantially cylindrical land, a divergent frusto conical exit surface which is inclined at an angle B° to give structural support to the ring material and rapid clearance from the side wall material. The shallow slope of the entry portion 24, spreads the compressive load so that the heat arising during incremental ironing in the entry, and sizing in the land can be dissipated into the ring material. The axial length of land 25 is kept short to avoid unnecessary heating of the cup material by frictional forces.

In a preferred embodiment that ring has

| | |
|---|---|
| Entry angle | 2° |
| Land length at axis | 0.635 mm |
| Exit angle | 6° |

Typically the entry surface and land surface have a surface finish of 2 microinch CLA. Working with apparatus as shown in FIG. 1 the clearance between the exterior surface of punch (of diameter 65 mm approx) and the land of each ring is typically:

0.241 mm of first ironing ring (26% reduction)
0.178 mm at second ironing ring (26% reduction)
0.105 mm at third ironing ring (41% reduction) to reduce of starting cup sidewall thickness 0.324 mm to an ironed wall thickness 0.105 mm. Suitable lubricants/coolants include GRACE 544A cupper lubricant (20% in water) or STUART OILS "DRAWSOL" 378M2 (6% water) or QUAKER 556 (6% in water) as are widely used in the trade.

It is possible to use lubricants not normally suitable for forming aluminium cans because the polymer coating prevents contact of aluminium on the die surface and metal fines formation. These materials can have the advantage of low content of linoleate derivatives and have beneficial effects on organoleptic properties of the containers. As an example, Quaker 556, a lubricant used commercially for tinplate cans but not aluminium cans, has a very low linoleate content but satisfactorily facilitates forming of PET coated aluminium cans.

In order to dissipate the heat arising at each wall ironing ring it is desirable that each ring is made of a material having a high thermal conductivity. We have made useful rings from the materials tabulated below which are dispersion strengthened materials having suitable chemical "affinity" and thermal conductivity greater than 50 W/m°C.:

TABLE 1

| MATERIAL | CONDUCTIVITY RANGE (W/M° C.) |
|---|---|
| Tungsten carbide/ceramic diboride in nickel matrix | 145–155 |
| Tungsten Carbide in nickel chromium matrix | 170–190 |
| Tungsten carbide in cobalt matrix | 65–100 |
| Tungsten nickel diboride in nickel chromium matrix | 115–122 |

These materials were suitable for producing conventional DWI aluminium and PET coated DWI aluminium cans.

TABLE 2

| MATERIAL | THERMAL CONDUCTIVITY (W/M° C.) |
|---|---|
| Partially stabilised Zirconia | 6–12 |
| Alpha - Silicon nitride | 15–22 |

Whilst a wall ironing ring made of partially stabilised Zirconia, having a thermal conductivity of 12 W/m°C., was effective when wall ironing uncoated tinplate, it was not effective when wall ironing our polyester-/aluminium laminate because of the affinity of Zirconia for aluminium.

A wall ironing ring made of alpha silicon nitride with a thermal conductivity of 20 W/m°C. induced coating marring with polyester coated aluminum 3004 but was satisfactory in forming uncoated aluminium.

TYPICAL CAN FORMING PARAMETERS IN THE COMPARATIVE EVALUATION

| | |
|---|---|
| Bodymaker speed | 180–280 cans per minute |
| Can wall gauge | |
| - thinwall | 0.0042 inches |
| - thickwall | 0.0068 inches |
| Base aluminium | 0.0118 inches |
| Trimmed can height | 125 mm |
| Can diameter | 65 mm |
| Cup diameter | 3.50 inches |
| Bodymaker coolant | DRAWSOL 919 at 3% |
| Blank diameter | 5.50 inches |

Figure 4:
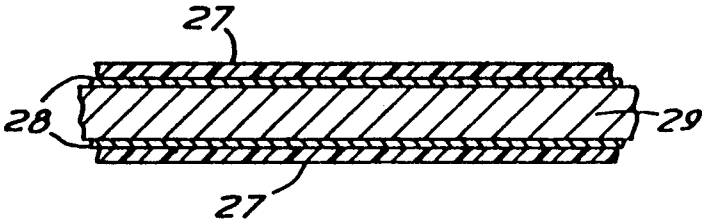
FIG. 4 is an enlarged sectioned side view of a fragment of a typical laminate from which the cup and wall ironed can body are made.

FIG. 4 shows a typical laminate of aluminium sheet and polymeric film—bonded to both major surfaces of the sheet by bonding layer.

More particularly we have found our ironing rings suitable for ironing the sidewall of cups made from a laminate composing layers of a polyester 27 such as polyethylene terephthalate in its amorphous state bonded by a co-polyester layer 28 to both sides of an aluminium alloy sheet 29 (e.g. Alloy 3004). The co-polyester 28 may be a copolyester such as isophthalate/-terephthalate/ethylene glycol or alternatively terephthalate/ethylene glycol/diethylene glycol; in their amorphous state. Typically, the thickness of the polyester layer 27 is in a range of 10 to 25 microns, the copolyester layer 28 is of the order of 2 microns; and the aluminium alloy 29 is about 300 microns thick. Taking the highest values of these ranges it will be understood that a total thickness of 324 microns of wall material of our drawn cup 17 is reduced by our exemplary tool pack to a final can wall thickness of about 105 microns. Some elastic springback of the laminate after wall ironing will give rise to a slightly thicker final wall than the clearance at the final ring e.g. 127 mm final thickness. For further details of these preferred PET laminate the reader is directed to our copending European Patent Application published No. 0312304.

It will be appreciated that the selected entry angles of our ironing rings impose a progressive reduction in sidewall thickness over a relatively long axial distance. This extra "thrust surface area" permits heat exchange between the sidewall and the ring material which acts as a heat sink. FIG. 3 shows that this gives rise to ironing rings which have an convergent entry 24 of longer axial length than the axial length of the divergent exit surface 26 if the axial thickness of the ring is limited to the same thickness as Prior art ironing rings.

Wall ironing rings having a compound slope of entry have been tried. In these compound rings the fusto conical entry between 1° and 4° is preceded by a frusto conical annulus of greater inclination to the axis, for example, between 4° and 10°. However, these compound convex surfaces gave no benefit in the wall ironing of cups made from our laminates of polyester and aluminium material.

We claim:

1. A wall ironing ring for use in cooperation with a Punch entered therethrough to reduce the thickness of a sidewall of a cup drawn from a laminate of a polyester film and sheet aluminium or sheet aluminium alloy; wherein a frusto conical entry surface to the ring converges at an angle between 1° and 4° to a central axis perpendicular to the plane of the ring and terminates at a land of short length, measured at said axis; wherein a divergent exit surface extends from said land at an angle in the range from 5° to 15°; and wherein the ring is made of a wear resistant material having a thermal conductivity greater than 50 W/m°C.

2. A wall ironing ring according to claim 1, comprising a first planar surface, a second planar surface, a peripheral wall joining said planar surfaces, and a bore defined by the convergent frusto conical entry surface, the land of short length and the divergent exit surface, wherein said land of short length, measured along said axis, is in the range of 0.25 mm to 1.25 mm.

3. A wall ironing ring according to claim 1 wherein the entry surface is inclined to the axis at an angle of 2°.

4. A wall ironing ring according to claim 1 wherein the convergent entry surface is longer than the divergent exit surface.

5. A wall ironing ring according to claim 3 wherein the land has a length measured at the axis, of 0.635 mm.

6. A wall ironing ring according to claim 4 wherein the ring is made from a material chosen from the group consisting of Tungsten carbide/ceramic diboride/nickel matrix
Tungsten carbide in nickel chromium matrix; and
Tungsten carbide in cobalt matrix.

7. A wall ironing ring according to claim 1 when mounted in a press tool assembly comprising a second ironing ring held apart from said ring by a hollow spacer.

8. A method of making a hollow vessel having an end wall spanning a tubular sidewall thinner than said end wall said method including the steps of: providing a cup formed from a laminate of a polyester film and aluminium or aluminium alloy sheet; mounting the cup on a punch and applying a coolant fluid to the exterior of the cup, passing the cup and punch through a wall ironing ring made of a wear resistant material having a thermal conductivity greater than 50 W/m°C. and having a frusto conical entry surface which converges at an angle in the range 1° to 4° to the axis of the punch to terminate in a substantially cylindrical land of length measured at the punch axis in a range of 0.25 mm to 1.25 mm to define with the punch a radial clearance less than the thickness of the side wall of the cup so that the sidewall becomes thinned and elongated divergent exit surface extends from said land at an angle in the range from 5° to 15°.

9. A method according to claim 8 wherein, after passage through first ironing ring, the punch is passed through a hollow spacer to clear the elongated cup from the ironing ring and receive further coolant before passage through a second ironing ring of like convergent angle and land length, but defining a smaller clearance between the punch and land than that between the first land and punch, to further thin and elongate the sidewall of the cup.

10. A method according to claim 8 wherein the convergent angle of the or each ring is 2° to the axis of the punch.

11. A method of manufacturing a wall ironed can body by cutting a disc from a sheet of aluminium or aluminium alloy; drawing a cup from the disc; and thereafter lubricating the cup with a coolant and ironing the sidewall of the cup to increase the height thereof characterised in that the aluminium or aluminium alloy sheet is laminated to a polyester film; in that the step of wall ironing is done by mounting the cup on a punch and pushing the drawn cup through an ironing ring having a frustoconical entry angle of between 1° and 4° and a short land defining a clearance, between punch and land, less than the thickness of the side wall of the cup; and in that said ironing ring is made of a wear resistant, material having a thermal conductivity greater than 50 W/m.°C., wherein a divergent exit surface extends from said land at an angle in the range 5° to 15°.

* * * * *